US006817161B1

(12) United States Patent
Wu et al.

(10) Patent No.: US 6,817,161 B1
(45) Date of Patent: Nov. 16, 2004

(54) SUPPORT FOR PROTECTING CONTAINERS HOLDING BREAKABLE SUBSTRATES

(75) Inventors: Yuan-Ming Wu, Taoyuan (TW); Chi-Sung Tsai, Hsinchu (TW); Tzu-Yen Lin, Hsinchu (TW); Chi-Yi Huang, Taipei (TW)

(73) Assignee: Taiwan Semiconductor Manufacturing Company, Hsinchu (TW)

( * ) Notice: Subject to any disclaimer, the term of this patent is extended or adjusted under 35 U.S.C. 154(b) by 162 days.

(21) Appl. No.: 10/150,834

(22) Filed: May 17, 2002

(51) Int. Cl.[7] ..... B65D 81/05

(52) U.S. Cl. ..... 53/449; 206/308.1; 206/446; 206/454; 206/523; 206/814

(58) Field of Search ..... 53/449; 206/308.1, 206/454, 413–416, 446, 523, 591, 594, 722, 723, 725, 814

(56) References Cited

U.S. PATENT DOCUMENTS 3,204,385 A * 9/1965 De Remer et al. ..... 53/412
4,201,293 A * 5/1980 Rigazio et al. ..... 206/301
5,415,286 A * 5/1995 Marchek et al. ..... 206/722
5,628,402 A * 5/1997 Dickie et al. ..... 206/521
6,126,002 A * 10/2000 Brown et al. ..... 206/320

* cited by examiner

*Primary Examiner*—Jim Foster

(57) ABSTRACT

An interposing cushion and method of application for stabilizing a cylindrical container placed in a rectangular cavity of a cushion structure. The interposing cushion includes a rectangular shaped base member adapted to fit a rectangular cavity in a cushion structure made for stacking inside a shipping box. The cushion structure is produced to protect rectangular shaped containers containing fragile objects. The base member has a top surface and a bottom surface and four sides. Four corner support members longitudinally extend upwards from the top surface. The support members form circumscribed inner surface segments for supporting the cylindrical container. The bottom surface has four shock absorbing spacer legs formed inboard of each corner.

20 Claims, 5 Drawing Sheets

SUPPORT FOR PROTECTING CONTAINERS HOLDING BREAKABLE SUBSTRATES

BACKGROUND OF THE INVENTION (1) Technical Field

This invention relates to safe handling of fragile substrates, and more particularly, to a support that is suitable for cushioning various shaped receptacles containing fragile substrates during transportation.

(2) Description of the Prior Art

Protecting fragile objects such as, for example, a plurality of semiconductor wafers held in containers are further contained in a collapsible cardboard box and packed with cushioning inserts is known. In general, a cushioning arrangement for isolating fragile objects from sudden vibration and shock is acknowledged. In such an application, either a rectangular shaped or around shaped container, each holding the plurality of semiconductor wafers, is placed within a corrugated paper box arranged with a cushioning foam. Earlier methods sandwiched the container, holding the plurality of fragile objects, between a lower and upper compressible styrene or polyurethane foam layers. Each layer having either a rectangular or round recess formed large enough to receive its appropriately shaped containers, each recess having side surfaces deep enough, under compression, to cover about one half of the container. The compressed foam material presses against all of the outside surfaces of the containers, thereby, packing and cushioning the containers from all sides. Such packing within the corrugated paper box intends to prevent destruction of the container which may occur by rough handling during transportation or by an outside influence causing shock, but more importantly, to prevent breakage or the like, of the fragile items contained within.

Presently, the cushioning arrangement is molded from a soft expanded polypropylene (EPP). The cushion material is formed as two half layers that are stackable around the container with a solid bottom layer, a solid top layer, and intermediate frame shaped layer. These layers fit around the container in the general way described earlier.

Several shaped containers are used by the semiconductor industry for containing the plurality of wafers, rectangular shaped and round shaped containers are in the majority, each requiring a form fit cushion for safe transportation. That is, it is not possible to fit a rectangular shaped container in a round recessed pocket or to sufficiently secure and stabilize a cylindrical shaped container within a rectangular recess pocket.

At present, three different cushion forms are used for packing. One type is for packing a single round container. a second is used for packing a single crystal container, the third form is used for packing two crystal containers Another disadvantage with the prior art is the increase in cost when shipping separate boxes containing specific shaped containers packed with form fitted cushions with the unlikelihood of receiving the two packages at the same time.

Presently, regulations drafted by concerned environmental agencies enforcing stringent controls towards waste products formed of styrene foam or polyurethane foam are currently in place. The problematic waste product is an important concern to global sanitation.

SUMMARY OF THE INVENTION

The present invention has been accomplished in view of the above mentioned problems. The main object of the present invention is to securely cushion both rectangular and round shaped containers containing a plurality of fragile objects using a stackable cushion design intended for cushioning only rectangular shaped containers. The cushion material is formed in two halves, a top half and a bottom half, each sandwiching the container between and around its four sides. Both halves are interchangeable, having the same form with a major top surface and a major bottom surface and four sides. A rectangular recess, having size and depth dimensions to cover about one half of a rectangular container, is centrally formed on one of the major surfaces of each half. These layers sandwich and fit around the container in the general way described in the prior art.

More specifically, the invention provides a cushion interposer to be removeably placed within the rectangular recess in each of the cushion halves, as described previously, the rectangular recesses were designed to conform to the shape of the rectangular containers. The interposer effects operative compatability between the two containers, thus providing cushioning and protection for the round container by employing one cushion design and one interposer design. The interposer is molded from a soft expanded polypropylene (EPP). This material is compressable between one thirtieth to one-fiftieth of its original volume. A further advantage of EPP, as compared with previously used materials, is that it rebounds to within about its original free state, thus making it reusable several times, thereby further reducing waste and cost. The round (cylindrical) shaped container holding a plurality of wafers, is placed into the bottom half of the interposer. The top half of the interposer is placed over the top half of the cylindrical container, which gives the outside appearance of a rectangular shaped container. The round container assembled with both interposer halves is then placed into the rectangular cavity of the cushion interposer designed to removeable fit in each of the rectangular recesses of the cushion halves, thereafter, converting the rectangular recess to a round recess. The interposer has a rectangular shaped outside form with a circumferential cavity formed therein for covering about one half of a cylindrical container.

Another object of the present invention is to reduce shipping costs by permitting the option of shipping round shaped and rectangular shaped containers within the same corrugated paper box.

Still another object of the present invention is to eliminate the need for providing a cushion specifically designed to cushion a round container.

Accordingly, the cushion interposer converts cushion structures which are designed to fit around a rectangular container, to fit and securely cushion a cylindrical container.

DETAILED DESCRIPTION OF THE PREFERRED EMBODIMENT

Figure 1:
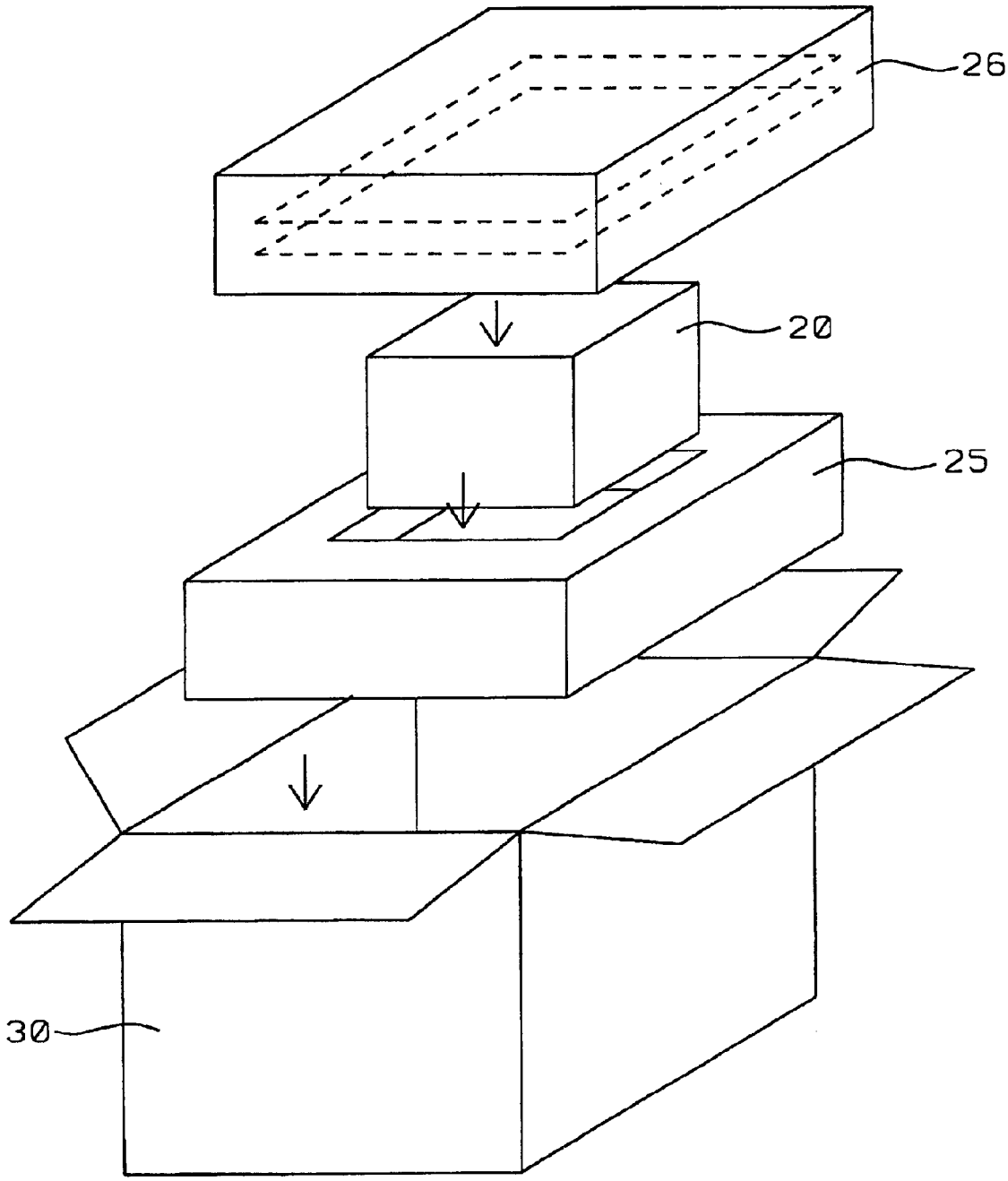
FIG. 1 is an exploded, perspective view schematically showing the packing arrangement of the prior art.

FIG. 1, illustrates the packing order of a crystal (rectangular shaped) container 20 that is used to hold a plurality of semiconductor wafers. The crystal container 20 is further contained in a collapsible cardboard box 30 and packed between cushion foam layers 25 and 26. In such an application, either a rectangular shaped container 20 or a round shaped container(not shown), holding the plurality of semiconductor wafers, is placed within the corrugated paper box 30 and sandwiched between form fitted cushion foam layers. Each of the upper and lower cushion foam layers having either a rectangular or round recess formed large enough to receive about one half of the container. The compressed foam material presses against the outside surfaces of the containers, thereby, packing and cushioning the containers around its sides. Such packing within the corrugated paper box intends to prevent destruction of the container which may occur by rough handling during transportation or by an outside influence causing shock, but more importantly, to prevent breakage or the like, of the fragile items contained within. Presently, the cushioning arrangement is molded from a soft expanded polypropylene (EPP).

Figure 2:
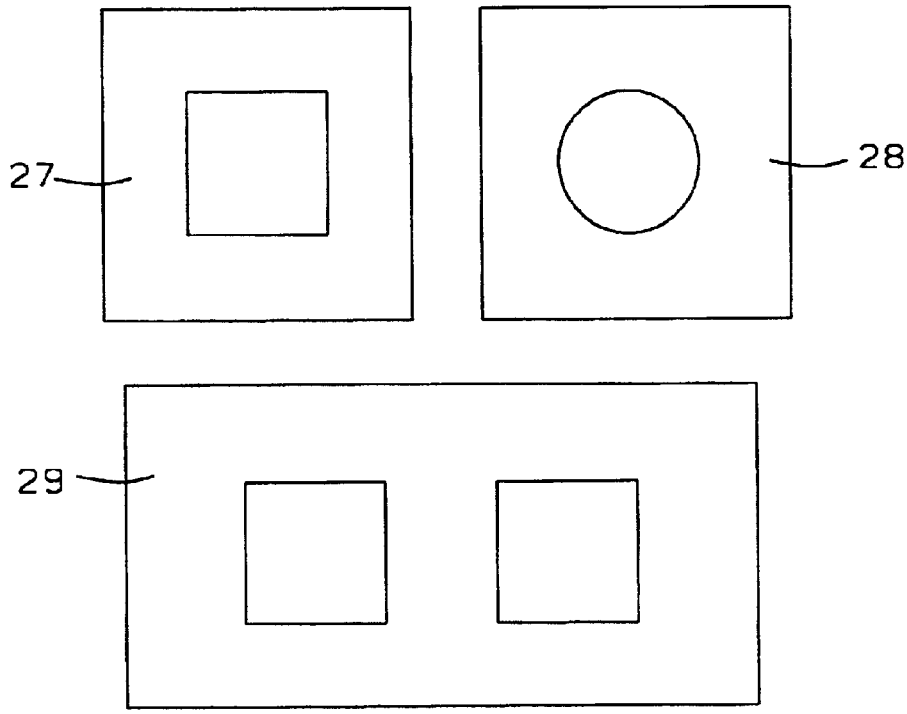
FIG. 2 is a plan view schematically showing three different cavity shapes currently used for packing.

FIG. 2 illustrates three different cushion cavities currently used for packing. A first cavity pattern 27 for packing a single crystal container, a second cavity pattern 28 for packing a single cylindrical container, and a third cavity pattern 29 used for packing two crystal containers As mentioned earlier, an obvious disadvantage with the prior art is the cost providing three sets of cushions that are needed for packing the three variations separately. It is effectively impossible to pack the rectangular container 20 in the round cavity 28 and extremely risky to pack the cylindrical container 21 in the rectangular cavity 27. The third cavity pattern 29 having two rectangular cavities, can only be used to ship the rectangular containers. Moreover, when shipping two separate packages, one holding a cylindrical container, the other holding a rectangular container the likelihood of receiving the two packages at the same time is very small.

Figure 3:
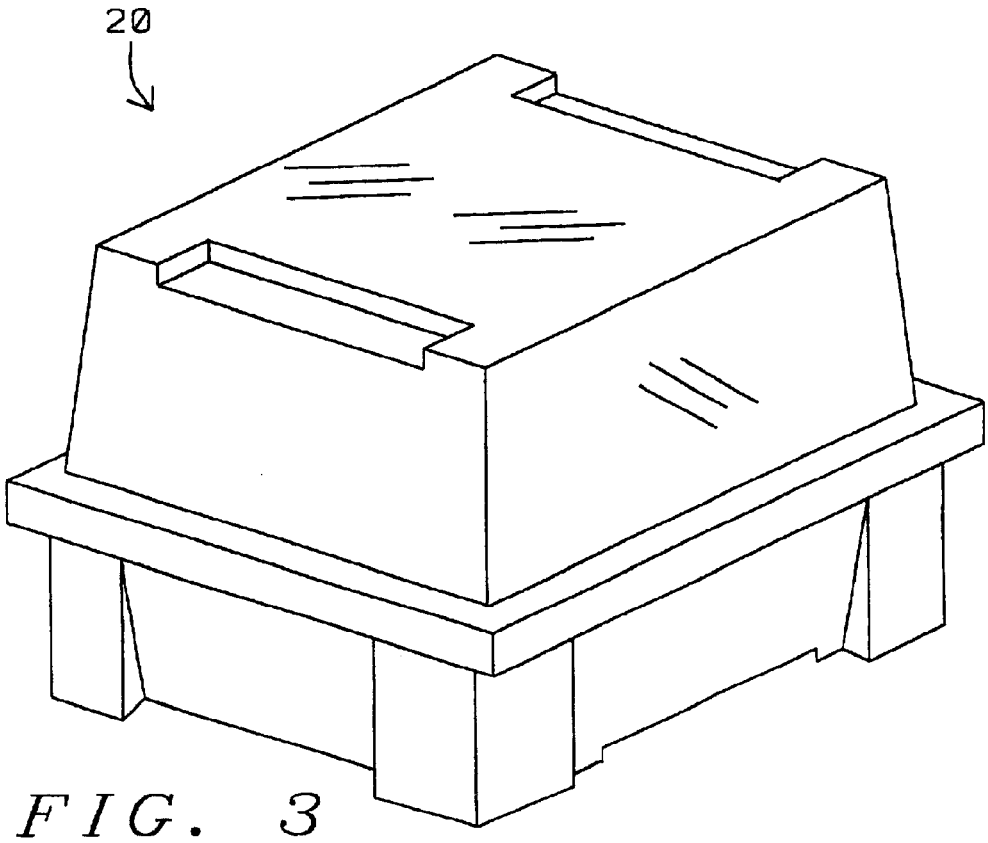
FIG. 3 is a perspective view illustrating the rectangular shaped wafer container.
Figure 4:
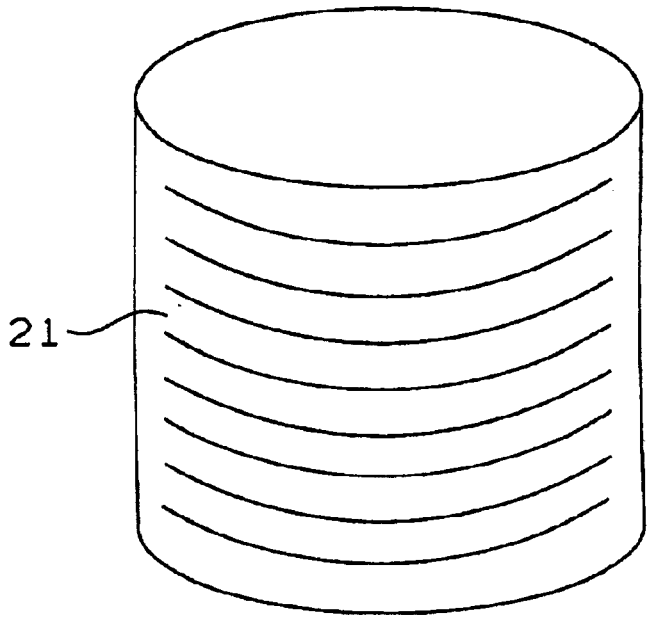
FIG. 4 is a perspective view illustrating the cylindrical shaped wafer container.
Figure 5:
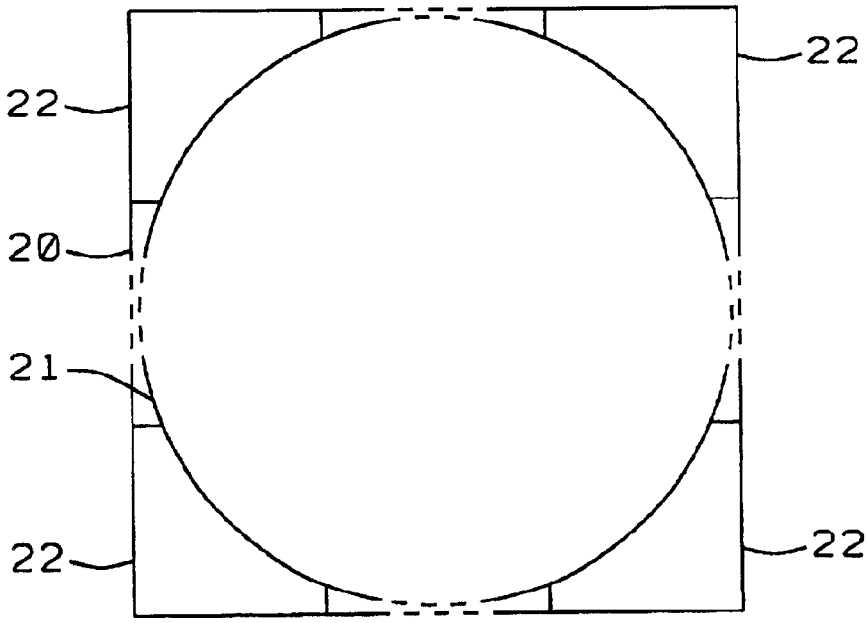
FIG. 5 shows a view of the round container superimposed on the crystal container.
Figure 6:
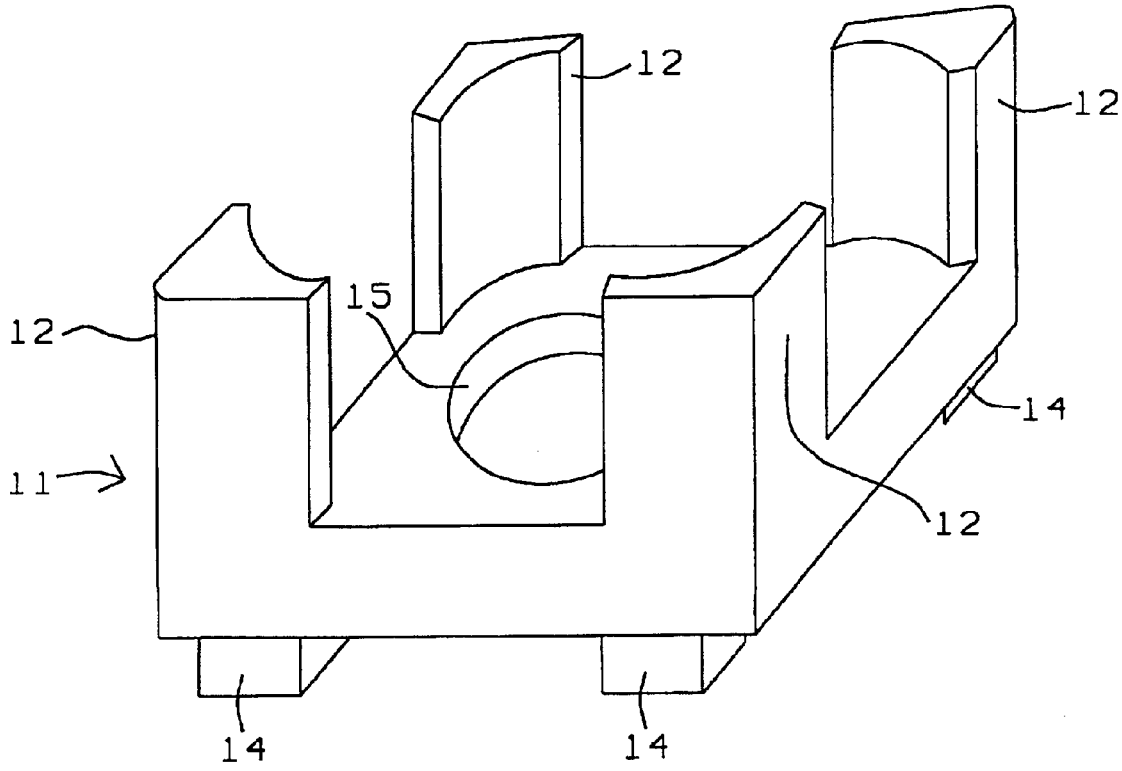
FIG. 6 is a perspective view of the bottom half of the cushion interposer, according to the invention.
Figure 7:
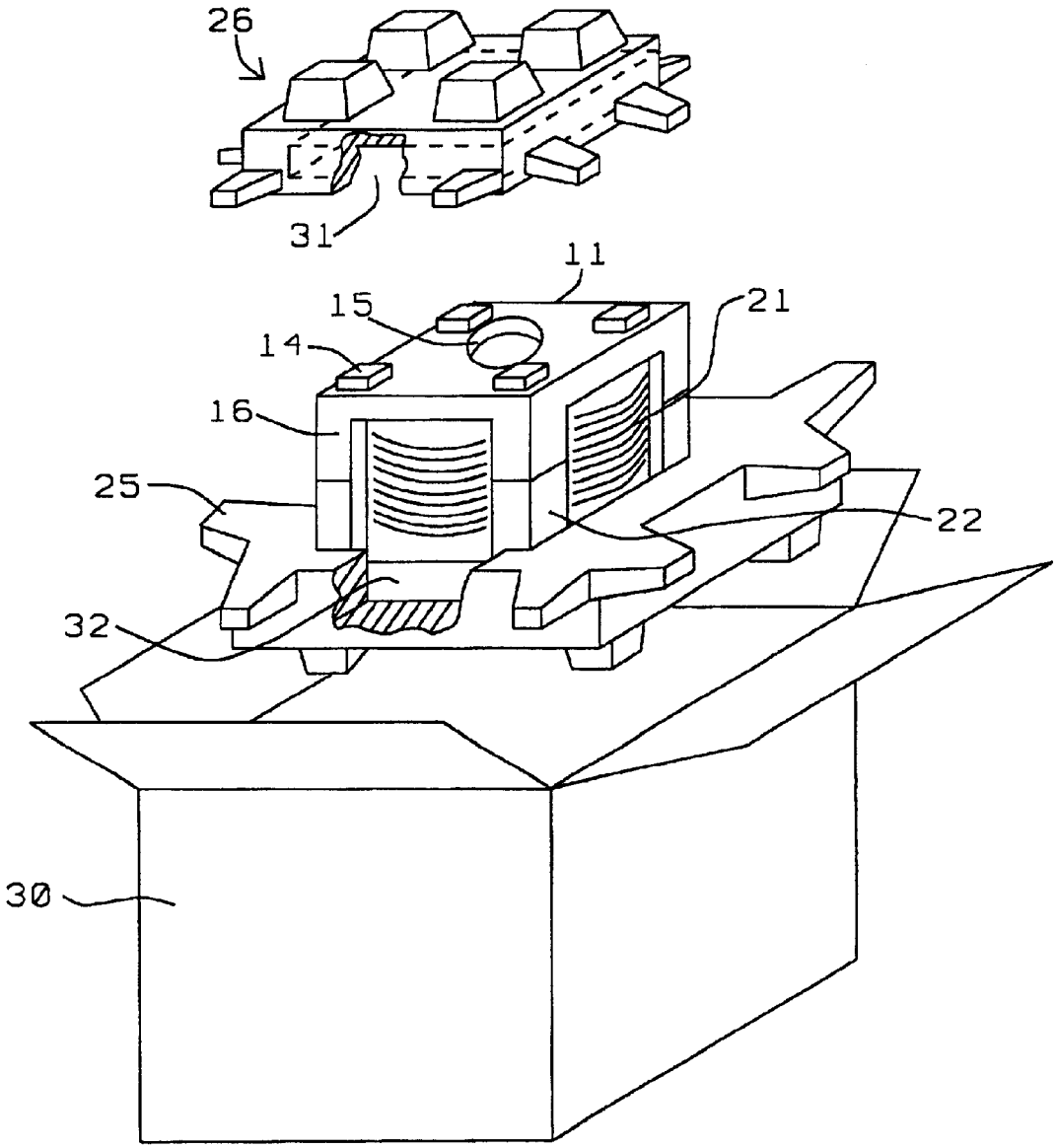
FIG. 7 is an exploded, perspective view showing the packing arrangement according to the invention.

FIGS. 3 and 4 depicts the representative shapes of the crystal 20 and round containers 21, respectively. FIG. 5 shows a plan view of an overlay of the shape of a round container 21 superimposed on the shape of a crystal container 20. The purpose of this is to illustrate the synthesis for the integrated design. The four corner patterns, shown truncated and in darker segments, illustrate the basis for the design of a cushion interposer. The objective of the present invention, as stated earlier, is to securely cushion both the crystal 20 and round 21 shaped containers with one cushion design. The cushion material, using EPP, would be formed in two halves, a top half and a bottom half, each sandwiching the container between and around its four sides. Both halves are interchangeable, having the same form with a major top surface and a major bottom surface and four sides with energy absorbing spacer blocks. A rectangular recess, having size and depth dimensions to cover about one half of a rectangular container, is centrally formed on one of the major surfaces of each half. Both layers sandwich and fit around the container in the general way described in the prior art. The conclusion of this study is to utilize the available EPP cushion designs for packing the single crystal containers and for packing the double crystal containers, in combination with the following:

Referring now to FIGS. 6 and 7, the invention provides a cushion interposer 11 to be removeably placed within the rectangular recess 31, 32, shown in partial section, in each of the cushion halves 26, 27, as described previously, in which the rectangular recesses 31, 32, shown in cutaway access, were designed to conform to the shape of the crystal containers. The interposer effects packing compatibility between the two containers, thus providing cushioning and protection for the round container 21 by employing the existing cushion design 25 and 26 and a novel interposer design. The cushion interposer 11 is molded from a soft expanded polypropylene (EPP). This material is compressable between one thirtieth to one-fiftieth of its original volume. A further advantage of EPP, as compared with previously used materials, is that it rebounds to within about its original free state, thus making it reusable several times, moreover, reducing waste and cost. The shape of the interposer is illustrated in FIG. 6 showing a perspective view of the bottom half. The top half is identical to the bottom half in all details, therefore, the descriptive details apply to both halves, the top half being inverted when used. A base member 10 having four absorber spacer elements 14 formed inboard of each corner on the bottom surface. A window opening 15 is centered extending from the top surface to the bottom surface showing visual access to the container.

The four corner patterns 22, shown truncated and in darker segments in FIG. 5 are the basis for the interposer design, are developed upward forming longitudinal supports 12 cushioning the sides of the cylindrical container. The length of the longitudinal supports are about one half the height of a cylindrical container. The round cavity is provided by the circumferential surface segments 13 formed inboard of each longitudinal support 12.

FIG. 7 illustrates the method in which a crystal cushion in used in combination with the cushion interposer to safely pack a cylindrical shaped container holding a plurality of wafers. The round container is placed into the round cavity formed by the circumferential segments 13 formed inboard of each longitudinal support 12 in the bottom half of the interposer. The top half of the interposer is placed over the top half of the cylindrical container, giving the interposer assembly an outside appearance of a rectangular shaped container 16. The design of the interposer assembly is intended to fit into the rectangular cavity of the crystal container cushion, thereafter making a secure packing arrangement for a cylindrical container.

The advantage of the present invention reduces cost given the option of shipping round shaped and rectangular shaped containers together using the two cavity cushion and within the same corrugated paper box or in any of the combinations considered necessary. Moreover, the round cavity cushion would no longer be stocked.

While the invention has been particularly shown and described with reference to the preferred embodiments thereof, it will be understood by those skilled in the art that various changes in form and details may be made without departing from the spirit and scope of the invention.

What is claimed is:

1. A two piece cushioning adapter to accommodate a cylindrical container protecting a plurality of fragile substrates in a rectangular cavity of a cushion structure, said cushioning adapter comprising:

two interchangeable halves, each half having top and bottom surfaces, a rectangular outer profile, a circumferential inner profile and a window extending from said top to said bottom surfaces;

each half having four corner supporting columns longitudinally extending upwards from said top surface, said corner support members forming an arcuate inner profile to accommodate said cylindrical container, and four shock absorbing spacer legs formed inboard of each corner of said bottom surface, said two piece cushioning adapter is used in place of a rectangular container containing fragile substrates.

2. The adapter of claim 1 wherein said outer profile is made to fit said rectangular cavity in said cushion structure.

3. The adapter of claim 1 wherein said rectangular cavity formed in said cushion structure is produced for cushioning a rectangular shaped container containing a plurality of fragile objects.

4. The adapter of claim 1 wherein said corner supporting columns are about half the length of a cylindrical container.

5. The adapter of claim 1 wherein the adapter material is polypropylene.

6. The adapter of claim 1 wherein the polypropylene material has a softness in the range of 30 to 50 as measured by the ratio of compression from its compressed to its relaxed volume.

7. The adapter of claim 1 wherein the adapter is reuseable after being removed from said rectangular cavity making said cushion structure available for protecting a rectangular container.

8. The adapter of claim 1 wherein the fragile objects contained in said cylindrical container are semiconductor wafers.

9. A method for stabilizing a cylindrical container in a rectangular cavity of a cushion structure, comprising the steps of:

providing at least one cylindrical container accommodating at least one fragile object;

providing a two piece cushioning adapter having two interchangeable halves, each half having top and bottom surfaces, a rectangular outer profile, a circumferential inner profile and a window extending from said top to said bottom surfaces;

each half having four corner supporting columns longitudinally extending upwards from said top surface, said corner support members forming an arcuate inner profile to accommodate said cylindrical container, and four shock absorbing spacer legs formed inboard of each corner of said bottom surface, said two piece cushioning adapter is used in place of a rectangular container in said cushion structure.

10. The method of claim 9, further comprising the steps of:

providing at least one packing kit, wherein each packing kit includes:

a cardboard shipping box containing;

a pair of interchangeable rectangular shaped cushion structures, each having at least one rectangular cavity to protect at least one rectangular shaped container, or to protect a two piece cushioning adapter accommodating a cylindrical container.

11. The method of claim 9 further comprising the steps of:

removing the top rectangular cushion structure from said cardboard box;

placing a cushioning adapter into said rectangular cavity of said bottom cushion structure, said cushioning adapter positioned with arcuate columns facing upwards;

placing said cylindrical container containing at least one fragile substrate into said cushioning adapter;

placing second of two halves of said cushioning adapters, with arcuate columns facing downward, over top of said cylindrical container;

placing second rectangular shaped cushion structure cavity facing down, over top of said cushioning adapter therein stabilizing and enclosing said cylindrical container within said cardboard box.

12. The method of claim 11 wherein said base cushioning adapter is made to fit said rectangular cavity in said cushion structure.

13. The method of claim 11 wherein said rectangular cavity formed in said cushion structure is produced to cushion a rectangular shaped container containing a plurality of fragile objects.

14. The method of claim 9 wherein said corner supporting columns are about one half the height of a cylindrical container.

15. The method of claim 9, wherein the cushioning adapter material is polypropylene.

16. The method of claim 9 wherein the polypropylene material has a softness in the range of 30 to 50 as measured by the ratio of compression from its compressed to its relaxed volume.

17. The method of claim 9 wherein the cushioning adapter is removable from said rectangular cavity in said cushion structure and thereafter reusable.

18. The method of claim 9 wherein the fragile objects contained in said container are semiconductor wafers.

19. The method of claim 9 wherein said cushioning adapter and method of use is also applicable for cushion structures having any number of rectangular cavities and for any combinations of rectangular and cylindrical containers packaged within said cushion structure.

20. The method of claim 11 wherein use of said cushioning adapter provides common usage for available cushion structures designed for rectangular containers while eliminating a need for cushion structures having round cavities.

* * * * *